United States Patent [19]

Leikert et al.

[11] 4,436,038

[45] Mar. 13, 1984

[54] METHOD OF PREPARING PULVERIZED FUEL WITHDRAWN FROM A PRIMARY FUEL FLOW FOR A PULVERIZED FUEL PILOT LIGHT BY MEANS OF A SIFTER DEVICE OR A SUPPLEMENTAL PULVERIZING PLANT

[75] Inventors: Klaus Leikert, Gummersbach; Klaus-Dieter Rennert, Marienheide, both of Fed. Rep. of Germany

[73] Assignee: L. & C. Steinmüller GmbH, Gummersbach, Fed. Rep. of Germany

[21] Appl. No.: 348,252

[22] Filed: Feb. 12, 1982

[30] Foreign Application Priority Data

Feb. 16, 1981 [DE] Fed. Rep. of Germany ..... 3105626

[51] Int. Cl.[3] ..... F23D 1/00

[52] U.S. Cl. ..... 110/347; 110/232; 110/263

[58] Field of Search ..... 110/263, 347, 232

[56] References Cited

U.S. PATENT DOCUMENTS

| | | | |
|---|---|---|---|
| 4,221,174 | 9/1980 | Smith et al. | 110/265 |
| 4,241,673 | 12/1980 | Smith et al. | 110/347 |
| 4,253,403 | 3/1981 | Vatsky | 110/263 X |
| 4,332,207 | 6/1982 | Blaskowski et al. | 110/347 |
| 4,373,451 | 2/1983 | Gardner et al. | 110/347 X |

*Primary Examiner*—Edward G. Favors

*Attorney, Agent, or Firm*—Becker and Becker

[57] ABSTRACT

A method of igniting a pulverized-coal annular burner flame having an internal back flow region, with the ignition energy being introduced centrally into the interior of the back flow region of the pulverized-coal annular burner flame. The ignition energy for the annular burner flame is furnished by an ignited pulverous fuel igniting flame or pilot light, which is operated with pulverous fuel having a different coarseness and/or consistency than does the primary fuel. The pulverous fuel, which is to be prepared for supplying a pulverous fuel pilot light, is withdrawn from the conduit of the primary fuel after an existing pulverizing plant. The pulverized fuel is withdrawn by means of a withdrawal device which is capable of being shut off, with the removal opening thereof being directed counter to the direction of the primary fuel flow.

5 Claims, 2 Drawing Figures

METHOD OF PREPARING PULVERIZED FUEL WITHDRAWN FROM A PRIMARY FUEL FLOW FOR A PULVERIZED FUEL PILOT LIGHT BY MEANS OF A SIFTER DEVICE OR A SUPPLEMENTAL PULVERIZING PLANT

The present invention relates to a method of igniting a pulverized-coal annular burner flame having an integral back flow region, with the ignition energy being introduced centrally into the interior of the back flow region of the pulverized-coal annular burner flame; the ignition energy for the annular burner flame is furnished by an ignited pulverized-fuel igniting flame or pilot light, which is operated with pulverized fuel having a different coarseness and/or consistency than does the primary fuel.

Coal or another solid fuel is employed as pulverous ignition fuel for the operation of a pulverized-fuel igniting flame, or pilot light, especially with pulverized-coal firing. Withdrawal of the ignition fuel directly from the primary fuel is desirable for economic reasons in order to avoid a costly special or separate production of the ignition fuel.

It is therefore an object of the present invention to provide a method with which the fuel for supplying the pulverized fuel pilot light is withdrawn from the primary fuel and is appropriately prepared by means of a subsequent treatment.

Figure 1:
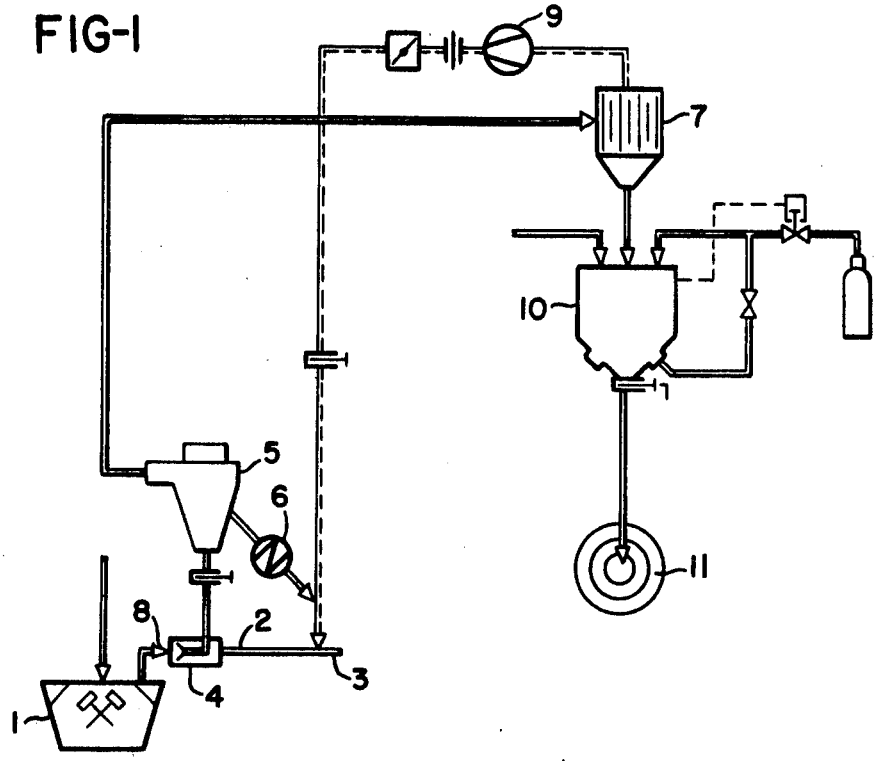
Figure 2:
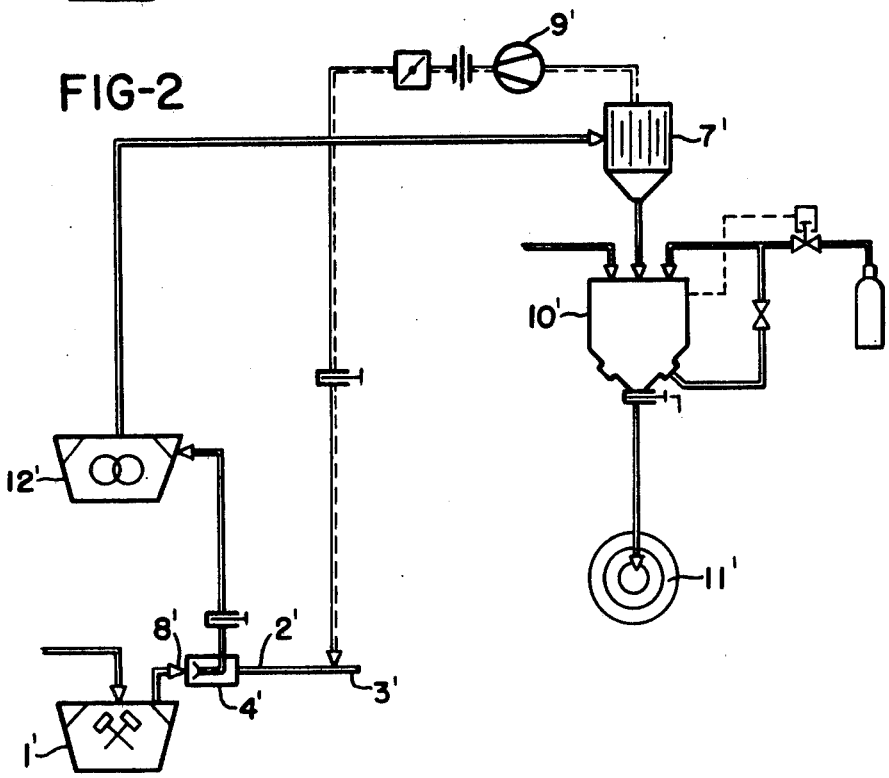

This object, and other objects and advantages of the present invention, will appear more clearly from the following specification in connection with the accompanying drawings, in which:

FIG. 1 schematically illustrates one embodiment for carrying out the method of the present invention; and FIG. 2 schematically illustrates another embodiment for carrying out the method of the present invention.

The method of the present invention is characterized primarily by withdrawing the pulverized fuel, which is to be prepared for supplying a pulverized fuel pilot light, from the conduit of the pneumatically conveyed primary fuel after an existing pulverizing or grinding plant; the pulverized fuel is withdrawn via a withdrawal device with is capable of being shut off, with the withdrawal opening thereof being directed counter to the direction of the primary fuel flow. The quantity of the ignition fuel/carrier air mixture withdrawn by means of the withdrawal device can be regulated in conformity to the output of the pulverizing plant. Accordingly, the method includes the step of regulating the quantity of fuel/carrier air withdrawn by the withdrawal device in conformity with the output of the pulverizing plant.

The grain-size distribution of the pulverized ignition fuel necessary for the operation of the pulverized fuel pilot light is achieved by varying the setting or adjustment of a shifter which follows the withdrawal device, with the coarse grain portion of the ignition fuel being returned via a sluice device into the conduit of the primary fuel, while the fine grain portion, in contrast, after separation of the carrier air, is temporarily stored in a deactivatable bunker before being supplied to the fuel igniting flame or pilot light.

According to another proposal for solving the object of the present invention, the required grain-size distribution of the pulverous ignition fuel is adjusted by means of a supplemental pulverizing plant connected subsequent to the withdrawal device, after which the prepared dignition fuel, after separation of the carrier air, is temporarily stored in a deactivatable bunker.

In all of the aforementioned situations, the purified carrier air, i.e. after separation from the ignition fuel, is returned to the primary fuel flow after the withdrawal location.

Referring now to the drawings in detail, in the embodiment according to FIG. 1, a primary pulverized coal/carrier air mixture is conveyed from a pulverizing or grinding plant 1 via a conduit system 2 to the main burner 3. In conformity with the output of the pulverizing plant 1, a fuel/carrier air quantity is withdrawn by means of the induced-draft blower 9 via the withdrawal device 4, which is capable of being shut off, and the withdrawal opening of which is directed counter to the direction of the primary fuel flow. This withdrawn fuel/carrier air quantity is conveyed to a sifter 5, where the desired grain-size distribution of the pulverous ignition fuel is achieved by varying the adjustment of the sifter 5. The coarse grain portion of the ignition fuel, after mixing thereof interspersed with the purified carrier air conveyed from the separator 7 via the induced-draft blower 9, is returned from output of sifter 5 via a sluice device 6 into the conduit of the primary fuel after the withdrawal location 8. The fine grain portion, in contrast, after separation of the carrier air in the separator 7, is temporarily stored in a deactivatable bunker 10, from which the pulverized fuel igniting flame or pilot light 11 is supplied.

According to FIG. 2, the fuel, which together with carrier air is withdrawn from the conduit 2′ of the primary fuel at the withdrawal location 8′ by means of the induced-draft blower 9′, is processed in a supplemental pulverizing plant 12′ to the required grain-size distribution. The ignition fuel/carrier air leaving the supplemental pulverizing plant are separated from each other in the separator 7′. The ignition fuel, prior to being used for the pulverous fuel pilot light 11′, is temporarily stored in a deactivatable bunker 10′, and the purified carrier air is introduced by means of the induced-draft blower 9′ into the conduit of the primary fuel after the withdrawal location 8′.

The present invention is, of course, in no way restricted to the specific disclosure of the specification and drawings, but also encompasses any modifications within the scope of the appended claims.

What we claim is:

1. A method of preparing pulverized ignition fuel for igniting a pulverized-fuel annular burner flame having an internal back flow region, with the ignition energy for said annular burner flame being introduced centrally into the interior of the back flow region of the annular burner flame, said method comprising the steps of:

supplying said burner with a pulverized fuel/carrier air mixture from a pulverizing plant via a primary fuel conduit;

providing a pilot light for furnishing said ignition energy, said pilot light being operated with pulverized ignition fuel having at least one of the characteristics of coarseness and consistency/different from the same characteristic of said primary fuel;

withdrawing said pulverized ignition fuel for said pilot light from said primary fuel conduit through the opening of a withdrawal device which is capable of being shut off;

processing said withdrawn pulverized ignition fuel prior to supplying same to said pilot light; and directing said withdrawal opening of said withdrawal device counter to the flow in said primary fuel conduit.

2. A method according to claim 1, which further includes the step of regulating the quantity of said pulverized ignition fuel/carrier air withdrawn by said withdrawal device in conformity with the output of said pulverizing plant.

3. A method according to claim 2, which further includes the steps of:

varying the setting of a sifter arranged subsequent to said withdrawal device in order to obtain the required grain-size distribution of said withdrawn pulverized ignition fuel in the carrier air;

returning the coarse-grain portion of said ignition fuel from said sifter into said primary fuel conduit via a sluice device; and separating the carrier air from the fine grain portion of said ignition fuel coming from said sifter, and temporarily storing said separated-off fine grain portion in a deactivatable bunker prior to supplying same to said pilot light.

4. A method according to claim 2, which further includes the steps of:

obtaining the required grain-size distribution of said withdrawn pulverized ignition fuel by means of a supplemental pulverizing plant arranged subsequent to said withdrawal device; and temporarily storing the thus processed pulverized ignition fuel in a deactivatable bunker prior to supplying same to said pilot light.

5. A method according to claim 3 or 4, which further includes the steps of separating said pulverized ignition fuel and carrier air withdrawn by said withdrawal device prior to supplying said pulverized ignition fuel to said pilot light, and returning said separated-off carrier air to said primary fuel conduit subsequent to said withdrawal location.

* * * * *